US007341468B2

(12) United States Patent
Hughes et al.

(10) Patent No.: US 7,341,468 B2
(45) Date of Patent: Mar. 11, 2008

(54) SEPARABLE LOADBREAK CONNECTOR AND SYSTEM WITH SHOCK ABSORBENT FAULT CLOSURE STOP

(75) Inventors: David Charles Hughes, Rubicon, WI (US); Paul Michael Roscizewski, Eagle, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/192,965

(22) Filed: Jul. 29, 2005

(65) Prior Publication Data

US 2007/0026713 A1 Feb. 1, 2007

(51) Int. Cl.
*H01R 13/53* (2006.01)

(52) U.S. Cl. ..... 439/185; 439/187

(58) Field of Classification Search ..... 439/181, 439/183, 184, 185, 187, 921
See application file for complete search history.

(56) References Cited

U.S. PATENT DOCUMENTS 4,088,383 A 5/1978 Fischer et al.
4,186,985 A * 2/1980 Stepniak et al. ..... 439/185
4,600,260 A 7/1986 Stepniak et al.
4,863,392 A * 9/1989 Borgstrom et al. ..... 439/185
5,445,533 A * 8/1995 Roscizewski et al. ..... 439/184
5,525,069 A 6/1996 Roscizewski et al.

OTHER PUBLICATIONS

Molded Rubber Products, Copper Power Systems, Jan. 1990, Marketing Material.
Loadbreak Apparatus Connectors, Cooper Power Systems, May 2003, Marketing Material.
International Search Report by the International Searching Authority for International Application No. PCT/US2006/029297; Nov. 10, 2006.

* cited by examiner

*Primary Examiner*—Thanh-Tam Le
(74) *Attorney, Agent, or Firm*—King & Spalding

(57) ABSTRACT

A separable loadbreak connector and system includes a connector having a contact tube with an axial passage therethrough, and a contact member slidably mounted within the axial passage and movable therein during a fault closure condition. The contact member is axially movable within the passage with the assistance of an arc quenching gas during the fault closure condition, and a shock absorbent stop element is mounted to the contact tube and limiting movement of the contact member in the fault closure condition.

40 Claims, 4 Drawing Sheets

SEPARABLE LOADBREAK CONNECTOR AND SYSTEM WITH SHOCK ABSORBENT FAULT CLOSURE STOP

BACKGROUND OF THE INVENTION

The invention relates generally to cable connectors for electric power systems, and more particularly to separable insulated loadbreak connector systems for use with cable distribution systems.

Electrical power is typically transmitted from substations through cables which interconnect other cables and electrical apparatus in a power distribution network. The cables are typically terminated on bushings that may pass through walls of metal encased equipment such as capacitors, transformers or switchgear.

Separable loadbreak connectors allow connection or disconnection of the cables to the electrical apparatus for service, repair, or expansion of an electrical distribution system. Such connectors typically include a contact tube surrounded by elastomeric insulation and a semiconductive ground shield. A contact piston is located in the contact tube, and a female contact having contact fingers is coupled to the piston. An arc interrupter, gas trap and arc-shield are also mounted to the contact tube. The female contact fingers are matably engaged with an energized male contact of a mating bushing, typically an elbow connector, to connect or disconnect the power cables from the apparatus. The piston is movable within the contact tube to hasten the closure of the male and female contacts and thus extinguish any arc created as they are engaged.

Such connectors are operable in "loadmake", "loadbreak", and "fault closure" conditions. Fault closure involves the joinder of male and female contact elements, one energized and the other engaged with a load having a fault, such as a short circuit condition. In fault closure conditions, a substantial arcing occurs between the male and female contact elements as they approach one another and until they are joined in mechanical and electrical engagement. Considerably more arc-quenching gas and mechanical assistance are required to extinguish the arc in a fault closure condition than in loadmake and loadbreak conditions, and it is known to use an arc-quenching gas to assist in accelerating the male and female contact elements into engagement, thus minimizing arcing time. A rigid piston stop is typically provided in the contact tube to limit movement of the piston as it is driven forward during fault closure conditions toward the mating contact.

It has been observed, however, that considerable force can be generated when the piston engages the piston stop, and in certain cases the force can be sufficient to dislodge the female finger contacts from the contact tube, leading to a fault close failure and sustained arcing conditions and hazard. Additionally, proper closure of the connector is dependent upon the proper installation and position of the piston stop, both of which are subject to human error in the assembly and/or installation of the connector, and both of which may result in fault closure failure and hazardous conditions. It would be desirable to avoid these and other reliability issues in existing separable interface connectors.

BRIEF SUMMARY OF THE INVENTION

According to an exemplary embodiment, a separable loadbreak connector is provided. The connector comprises a contact tube having an axial passage therethrough, and a contact member slidably mounted within the axial passage and movable therein during a fault closure condition. The contact member is axially movable within the passage with the assistance of an arc quenching gas during the fault closure condition, and a shock absorbent stop element is mounted to the contact tube and limiting movement of the contact member in the fault closure condition.

According to another exemplary embodiment, a separable loadbreak connector for making or breaking an energized connection in a power distribution network is provided. The connector comprises a conductive contact tube having an axial passage therethrough, an elastomeric insulation surrounding the contact tube, a conductive piston disposed within the passage and displaceable therein with the assistance of an arc quenching gas, a female contact member mounted stationary to the piston, and a shock absorbent stop ring element within the axial passage and restricting displacement of the piston.

According to another exemplary embodiment, a separable loadbreak connector to make or break a medium voltage connection with a male contact of a mating connector in a power distribution network is provided. The separable loadbreak connector comprises a conductive contact tube having an axial passage therethrough, an elastomeric insulation surrounding the contact tube, a conductive piston disposed within the passage and displaceable therein with the assistance of an arc quenching gas, a loadbreak female contact member mounted stationary to the piston, an arc interrupter adjacent the female contact member and movable therewith, and a nonconductive nosepiece coupled to the contact tube and including an integrally formed stop ring at one end thereof. The stop ring limits movement of the piston relative to the contact tube in a fault closure condition.

According to another exemplary embodiment, a separable loadbreak connector comprises passage means for defining an axial contact passage and loadbreak means, located within the axial contact passage, for making or breaking an energized electrical connection in a power distribution network. Positioning means are provided, coupled to the loadbreak means, for axially displacing the loadbreak means within the contact passage. Assistance means are provided, coupled to the positioning means, for displacing the positioning means during a fault closure condition. As arc interrupter means is provided, adjacent the loadbreak means and movable therewith, for quenching an electrical arc during loadmake and loadbreak conditions, and stop means are connected to the passage means for absorbing impact of the positioning means when the positioning means is displaced within the passage by a predetermined amount.

According to another exemplary embodiment, a separable loadbreak connector system to make or break a medium voltage energized connection in a power distribution network is provided. The system comprises a male connector having a male contact, and a female loadbreak connector. The female connector comprises a conductive contact tube having an axial passage therethrough, an elastomeric insulation surrounding the contact tube, a conductive piston disposed within the passage, and a loadbreak female contact member mounted stationary to the piston and configured to receive the male contact when the male and female connectors are mated. The female contact member and the piston is axially displaceable within the contact passage within the contact passage toward the male contact due to accumulated pressure of an arc quenching gas when the male and female connectors are mated to one another in a fault closure condition. An arc interrupter is adjacent the female contact member and movable therewith, and a shock absorbent stop element is configured to absorb impact of the piston during the fault closure condition and substantially prevent displacement of the piston beyond a predetermined distance within the contact tube.

DESCRIPTION OF THE INVENTION

Figure 1:
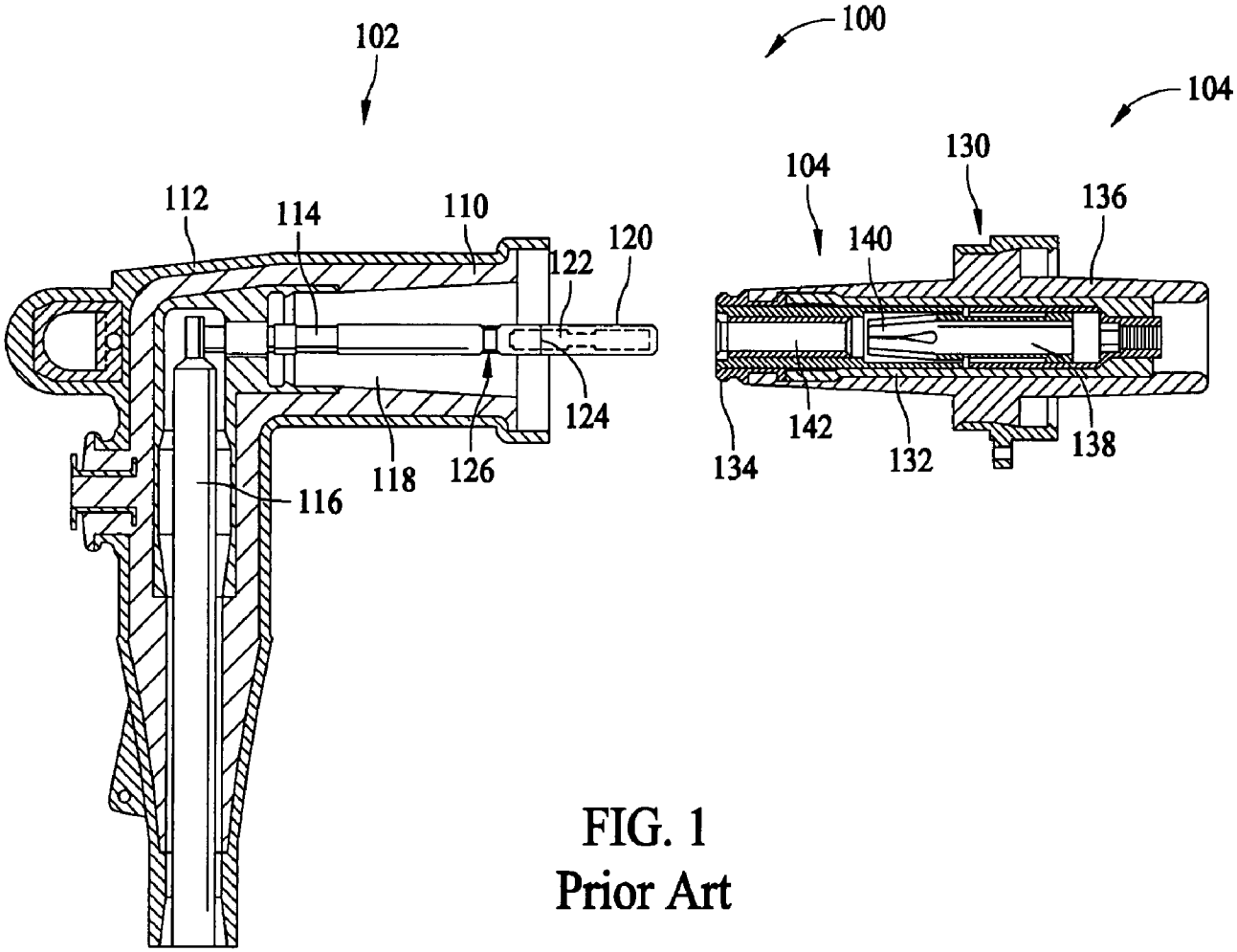
FIG. 1 Prior Art
FIG. 1 is a longitudinal cross-sectional view of a known separable loadbreak connector system.

FIG. 1 is a longitudinal cross-sectional view of a separable loadbreak connector system 100, the type of which may be employed with a connector according to the present invention, while avoiding reliability issues of known separable connectors as explained below.

As shown in FIG. 1, the system 100 includes a male connector 102 and a female connector 104 for making or breaking an energized connection in a power distribution network. The female connector 104 may be, for example, a bushing insert or connector connected to an electrical apparatus such as a capacitor, a transformer, or switchgear for connection to the power distribution network, and the male connector 102, may be, for example, an elbow connector, electrically connected to a power distribution network via a cable (not shown). The male and female connectors 102, 104 respectively engage and disengage one another to achieve electrical connection or disconnection to and from the power distribution network.

While the male connector 102 is illustrated as an elbow connector in FIG. 1, and while the female connector 104 is illustrated as a bushing insert, it is contemplated that the male and female connectors may be of other types and configurations in other embodiments. The description and figures set forth herein are set forth for illustrative purposes only, and the illustrated embodiments are but one exemplary configuration embodying the inventive concepts of the present invention.

In an exemplary embodiment, and as shown in FIG. 1, the male connector 102 may include an elastomeric housing 110 of a material such as EPDM (ethylene-propylene-dien-emonomer) rubber which is provided on its outer surface with a conductive shield layer 112 which is connected to electrical ground. One end of a male contact element or probe 114, of a material such as copper, extends from a conductor contact 116 within the housing 110 into a cup shaped recess 118 of the housing 110. An arc follower 120 of ablative material, such as cetal co-polymer resin loaded with finely divided melamine in one example, extends from an opposite end of the male contact element 114. The ablative material may be injection molded on an epoxy bonded glass fiber reinforcing pin 122. A recess 124 is provided at the junction between metal rod 114 and arc follower 120. An aperture 126 is provided through the exposed end of rod 114 for the purpose of assembly.

The female connector 104 may be a bushing insert composed of a shield assembly 130 having an elongated body including an inner rigid, metallic, electrically conductive sleeve or contact tube 132 having a non-conductive nose piece 134 secured to one end of the contact tube 132, and elastomeric insulating material 136 surrounding and bonded to the outer surface of the contact tube 132 and a portion of the nose piece 134. The female connector 104 may be electrically and mechanically mounted to a bushing well (not shown) disposed on the enclosure of a transformer or other electrical equipment.

A contact assembly including a female contact 138 having deflectable contact fingers 140 is positioned within the contact tube 132, and an arc interrupter 142 is provided proximate the female contact 138.

The male and female connectors 102, 104 are operable or matable during "loadmake", "loadbreak", and "fault closure" conditions. Loadmake conditions occur when the one of the contact elements, such as the male contact element 114 is energized and the other of the contact elements, such as the female contact element 138 is engaged with a normal load. An arc of moderate intensity is struck between the contact elements 114, 138 as they approach one another and until joinder under loadmake conditions. Loadbreak conditions occur when the mated male and female contact elements 114, 138 are separated when energized and supplying power to a normal load. Moderate intensity arcing again occurs between the contact elements 114, 138 from the point of separation thereof until they are somewhat removed from one another. Fault closure conditions occur when the male and female contact elements 114, 138 are mated with one of the contacts being energized and the other being engaged with a load having a fault, such as a short circuit condition. Substantial arcing occurs between the contact elements 114, 138 in fault closure conditions as the contact elements approach one another they are joined. In accordance with known connectors, arc-quenching gas is employed to accelerate the female contact 138 in the direction of the male contact element 140 as the connectors 102, 104 are engaged, thus minimizing arcing time and hazardous conditions.

Figure 2:
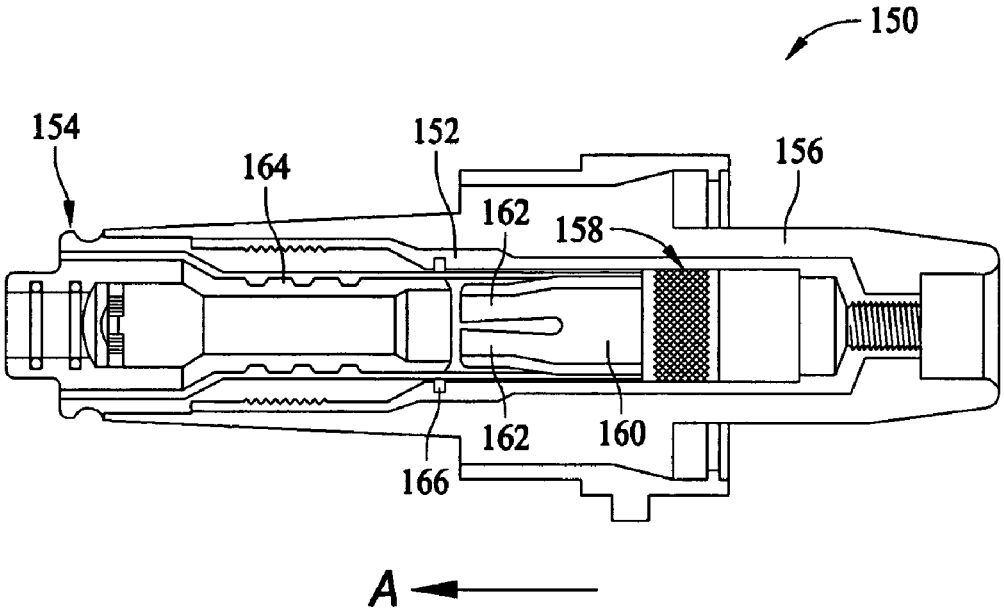
FIG. 2 Prior Art
FIG. 2 is an enlarged cross-sectional view of a known female contact connector that may be used in the system shown in FIG. 1.

FIG. 2 illustrates a typical female connector 150 that may be used in the electrical system 100 in lieu of the female connector 104 shown in FIG. 1. Like the connector 104, the female connector 150 includes an elongated body including an inner rigid, metallic, electrically conductive sleeve or contact tube 152 having a non-conductive nose piece 154 secured to one end of the contact tube 152, and elastomeric insulating material 156 surrounding and bonded to the outer surface of the contact tube 152 and a portion of the nose piece 154.

A contact assembly includes a piston 158 and a female contact element 160 having deflectable contact fingers 162 is positioned within the contact tube 152 and an arc interrupter 164 provided proximate the female contact 160. The piston 158, the female contact element 160, and the arc interrupter 164 are movable or displaceable along a longitudinal axis of the connector 150 in the direction of arrow A toward the male contact element 114 (FIG. 1) during a fault closure condition. To prevent movement of the female contact 160 beyond a predetermined amount in the fault closure condition, a stop ring 166 is provided, typically fabricated from a hardened steel or other rigid material. As previously mentioned, however, the considerable force that may result when the piston 158 impacts the stop ring 166 can lead to fault closure failure and undesirable operating conditions if the impact force is sufficient to separate the female contact 160 from the contact tube 150. Additionally, the reliability of the fault closure of the connector 150 is dependent upon a proper installation and position of the stop ring 166 during assembly and installation of the connector, raising reliability issues in the field as the connectors are employed.

Figure 3:
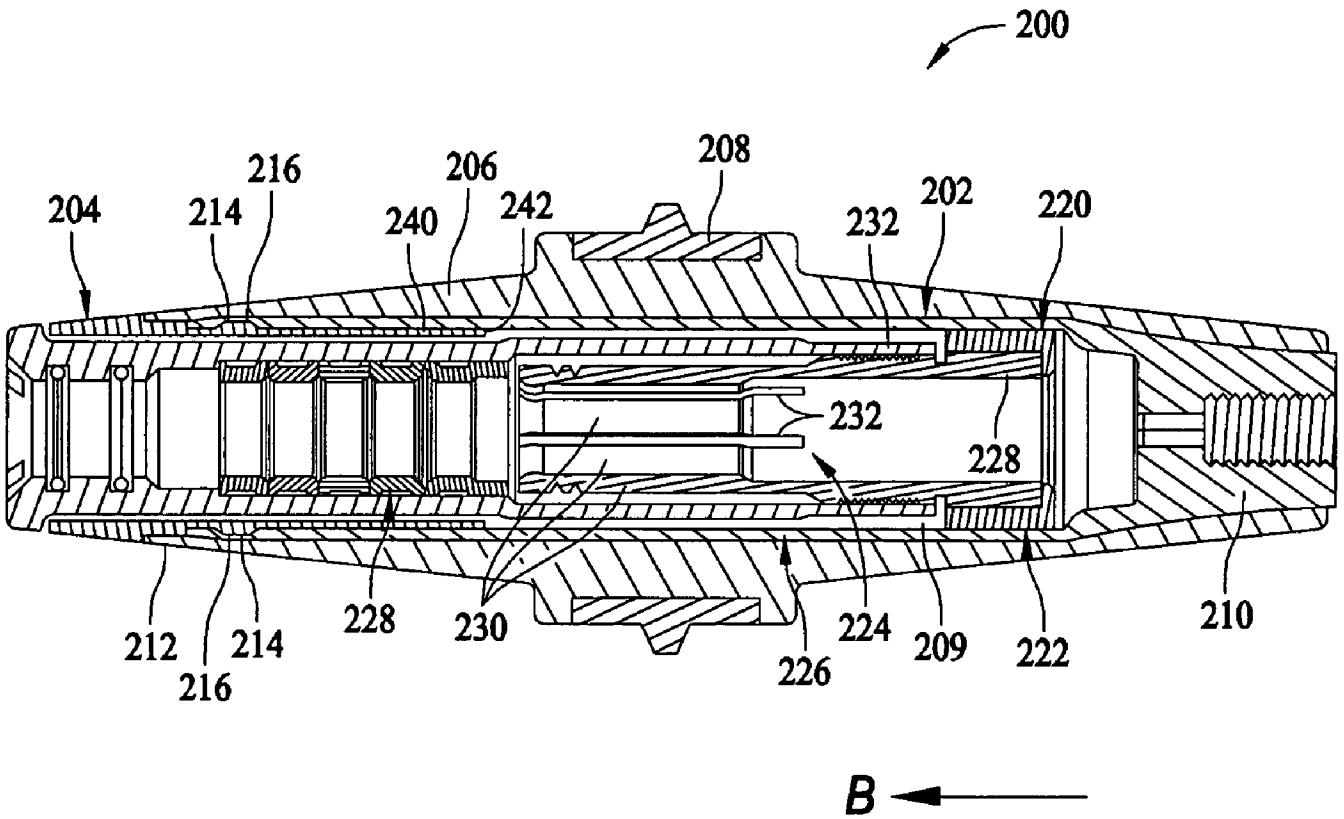
FIG. 3 is a cross sectional view of a female connector according to the present invention in a normal operating position.
Figure 4:
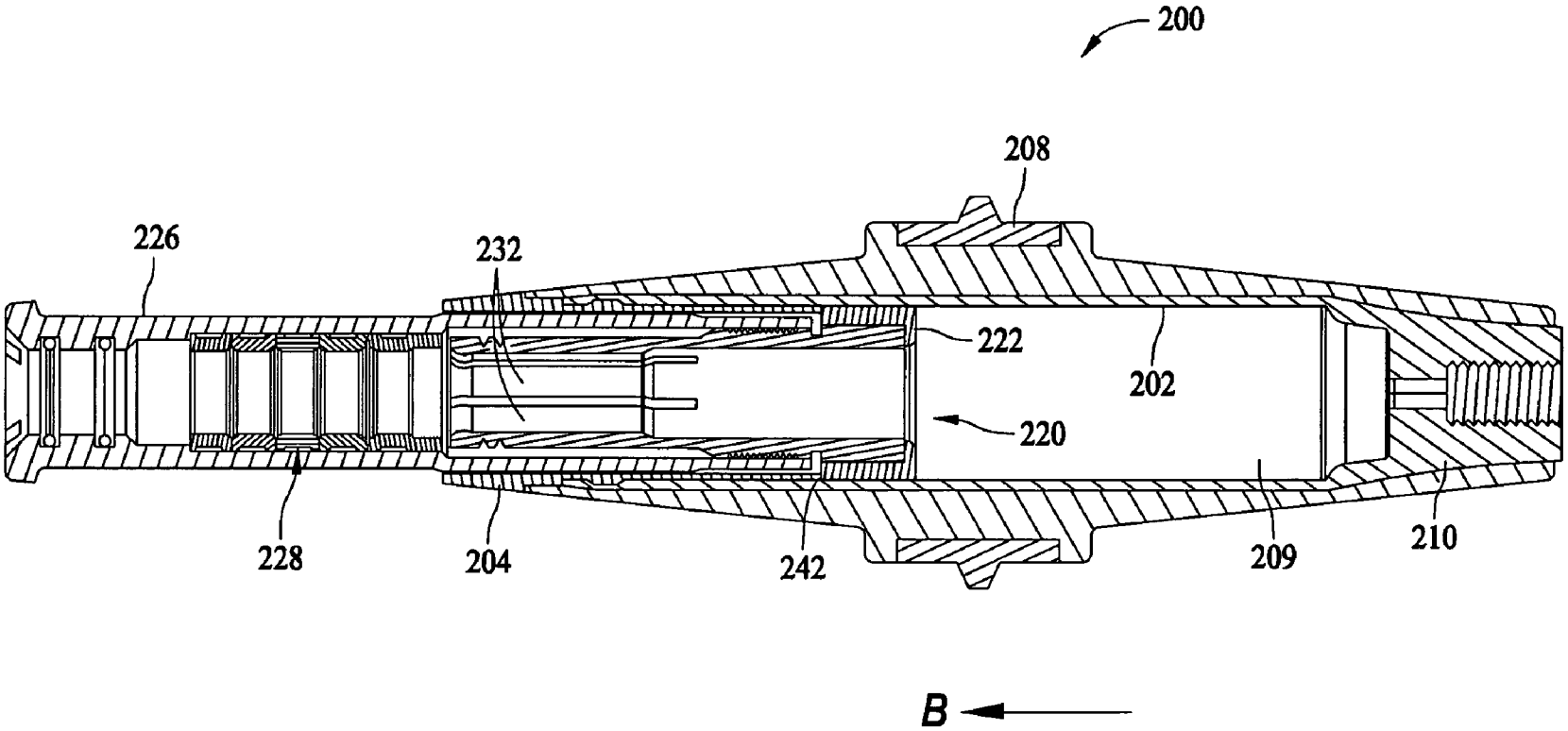
FIG. 4 is a cross sectional view of the female connector shown in FIG. 3 in a fault closure position.

FIGS. 3 and 4 illustrate a separable loadbreak connector 200 according to the present invention in a normal operating condition and a fault closure condition, respectively. The connector 200 may be used in the connector system 100 in lieu of either of the connector 104 (FIG. 1) or the connector 150 (FIG. 2), while avoiding the aforementioned reliability issues and fault closure failures to which known connectors are susceptible.

The connector 200, may be, for example, a bushing insert or connector connected to an electrical apparatus such as a capacitor, a transformer, or switchgear for connection to the power distribution network. In an exemplary embodiment, the connector 200 includes a conductive contact tube 202, a non-conductive nose piece 204 secured to one end of the contact tube 202, and elastomeric insulating material 206, such as EPDM rubber, surrounding and bonded to the outer surface of the contact tube 202 and a portion of the nose piece 204. A semiconductive ground shield 208 extends over a portion of the insulation 206.

In one embodiment, the contact tube 202 may be generally cylindrical and may have a central bore or passage 209 extending axially therethrough. The contact tube 202 has an inner end 210 with a reduced inner diameter, and the end 210 may be threaded for connection to a stud of a bushing well (not shown) of an electrical apparatus in a known manner. An open outer end 212 of the contact tube 202 includes an inwardly directed annular latching shoulder or groove 214 that receives and retains a latching flange 216 of the nosepiece 204.

In one embodiment, the conductive contact tube 202 acts as an equal potential shield around a contact assembly 220 disposed within the passage 209 of the tube 202. The equal potential shield prevents stress of the air within the tube 202 and prevents air gaps from forming around the contact assembly 220, thereby preventing breakdown of air within the tube during normal operation. While a conductive contact tube 202 is believed to be advantageous, it is recognized that in other embodiments a non-conductive contact tube may be employed that defines a passage for contact elements.

The contact assembly 220 may include a conductive piston 222, a female contact 224, a tubular arc snuffer housing 226, and an arc-quenching, gas-generating arc snuffer or interrupter 228. The contact assembly 220 is disposed within the passage 209 of the contact tube 202. The piston 222 is generally cylindrical or tubular in an exemplary embodiment and conforms to the generally cylindrical shape of the internal passage 209.

The piston 222 includes an axial bore and is internally threaded to engage external threads of a bottom portion 228 of the female contact 224 and fixedly mount or secure the female contact 224 to the piston 222 in a stationary manner. The piston 222 may be knurled at around its outer circumferential surface to provide a frictional, biting engagement with the contact tube 202 to ensure electrical contact therebetween to provide resistance to movement until a sufficient arc quenching gas pressure is achieved in a fault closure condition. Once sufficient arc quenching gas pressure is realized, the piston is positionable or slidable within the passage 209 of the contact tube 202 to axially displace the contact assembly 220 in the direction of arrow B to a fault closure position as shown in FIG. 4. More specifically, the piston 222 positions the female contact 224 with respect to the contact tube 202 during fault closure conditions.

The female contact 224 is a generally cylindrical loadbreak contact element in an exemplary embodiment and may include a plurality of axially projecting contact fingers 230 extending therefrom. The contact fingers 230 may be formed by providing a plurality of slots 232 azimuthally spaced around an end of the female contact 224. The contact fingers 230 are deflectable outwardly when engaged to the male contact element 114 (FIG. 1) of a mating connector to resiliently engage the outer surfaces of the male contact element.

The arc snuffer 228 in an exemplary embodiment is generally cylindrical and constructed in a known manner. The arc snuffer housing 226 is fabricated from a nonconductive or insulative material, such as plastic, and the arc snuffer housing 226 may be molded around the arc snuffer 228. As those in the art will appreciate, the arc interrupter 228 generates de-ionizing arc quenching gas within the passage 209, the pressure buildup of which overcomes the resistance to movement of the piston 222 and causes the contact assembly 220 to accelerate, in the direction of arrow B, toward the open end 212 of the contact tube 202 to more quickly engage the female contact element 224 with the male contact element 114 (FIG. 1). Thus, the movement of the contact assembly 220 in fault closure conditions is assisted by arc quenching gas pressure.

In an exemplary embodiment, the arc snuffer housing 226 includes internal threads at an inner end 232 thereof that engage external threads of the female contact 224 adjacent the piston 222. In securing the arc snuffer housing 226 to female contact 224, the arc interrupter 228 and female contact 224 move as a unit within the passage 209 of the contact tube 202.

The nose piece 204 is fabricated from a nonconductive material and may be generally tubular or cylindrical in an exemplary embodiment. The nose piece 204 is fitted onto the open end 212 of the contact tube 202, and extends in contact with the inner surface of the contact tube 202. An external rib or flange 216 is fitted within the annular groove 214 of the contact tube 202, thereby securely retaining the nose piece to 204 to the contact tube 202.

A stop element in the form of a stop ring 240 is integrally formed with the nose piece 204 at one end 242 thereof, and may be tapered at the end 242 as shown in FIG. 3. The stop ring 240 extends into the passage 209 of the contact tube 202 and faces the piston 222, and consequently physically obstructs the path of the piston 222 as it is displaced or moved in a sliding manner in the direction of arrow B during fault closure conditions. Hence, as the piston 222 moves in the direction of arrow B, it will eventually strike the stop ring 240. In an exemplary embodiment, the stop ring 240 extends around and along the full circumference of the tubular nose piece 204 and faces the piston 222 such that the piston 222 engages the stop ring 240 across its full circumference. The tapered end 242 reduces the structural strength of the stop ring 240 at the point of impact.

The stop ring 240, together with the remainder of the nose piece 204, may be fabricated from a non-rigid, compressible, or shock absorbing material that absorbs impact forces when the piston 222 strikes the stop ring 240, while limiting or restricting movement of the piston 222 beyond a predetermined or specified position within the contact tube 202. In other words, the stop ring 240 will prevent movement of the piston 222 relative to the contact tube 202 beyond the general location of the stop ring 240. With the shock absorbing stop ring 240, impact forces of the piston 222 are substantially isolated and absorbed within the stop ring 240, unlike known connectors having rigid piston stops that distribute impact forces to the remainder of the assembly, and specifically to the contact tube. By absorbing the piston impact with the stop ring 240, it is much less likely that impact forces will separate the female contact 224 and the contact fingers 230 from the contact tube, thereby avoiding associated fault closure failure.

Alternatively, the piston impact with the stop ring 240 may be absorbed by shearing of the nose piece 204, either wholly or partially, from the contact tube 202, such as at the interface of the noise piece flanges 216 and the annular groove 214 of the contact tube. The shearing of the nose piece material absorbs impact forces and energy when the piston 222 strikes the stop ring 240, and the resilient insulating material 206 may stretch to hold the nose piece 204 and the contact tube 202 together, further absorbing kinetic energy and impact forces as the piston 222 is brought to a stop. Potential tearing of the insulating material 206 may further dissipate impact forces and energy. Weak points or areas of reduced cross sectional area could be provided to facilitate shearing and tearing of the materials of predetermined locations in the assembly.

Still further, the piston impact with the stop ring 240 may be broken, cracked, shattered, collapsed, crushed or otherwise deformed within the contact tube 202 to absorb impact forces and energy.

It is understood that one or more the foregoing shock absorbent features may utilized simultaneously to bring the piston 222 to a halt during fault closure conditions. That is, shock absorption may be achieved with combinations of compressible materials, shearing or tearing of materials, or destruction or deformation of the materials utilized in the stop ring 240 and associated components.

Also, because the stop ring 240 is integrally formed in the nose piece 204, a separately provided stop ring common to known connectors, and the associated risks of incorrect installation or assembly of the piston stop and the connector, is substantially avoided. Because of the integration of the stop ring 240 into the nose piece 204 in a unitary construction, it may be ensured that the stop ring 240 is consistently positioned in a proper location within the contact passage 209 merely by installing the nose piece 204 to the contact tube. In an exemplary embodiment, and as shown in FIG. 3, the elastomeric insulating material 206 surrounds and is bonded to the outer surface of the contact tube 202 and a portion of the nose piece 204, thereby further securing the nose piece 204 in proper position relative to the contact tube 202.

Additionally, by integrating the stop ring 240 into the nosepiece construction, any chance of forgetting to install the stop ring is avoided, unlike known connectors having separately provided stop rings. With the integral nose piece 204 and stop ring 240, installation of the nose piece 204 guarantees the installation of the stop ring 240, and avoids inspection difficulties, or even impossibilities, to verify the presence of separately provided stop rings that are internal to the connector construction and are obstructed from view. A simpler and more reliable connector construction is therefore provided that is less vulnerable to incorrect assembly, installation, and even omission.

While integral formation of the stop ring 240 and the nose piece 204 is believed to be advantageous, it is recognized that the stop ring 240 may be a non-integral part of the nose piece 204 in other embodiments. For example, the stop ring 240 could be separately fabricated and provided from the nose piece 204, but otherwise coupled to or mounted to the nose piece 204 for reliable positioning of the stop ring 204 when the nose piece 204 is installed. As another example, the stop ring 242 could be otherwise provided and installed to the contact tube independently of the nose piece 204, while still providing shock absorbing piston deceleration in the contact tube.

Further, in alternative embodiments, the stop ring 240 may extend for less than the full circumference of nose piece 204, thereby forming alternative stop elements that engage only a portion of the piston face within the contact passage 209. Additionally, more than one shock absorbent stop element, in ring form or other shape, could be provided to engage different portions of the piston 222 during fault closure conditions. Still further, shock absorbent stop elements may be adapted to engage the female contact 224, or another part of the contact assembly 220, rather than the piston 222 to prevent overextension of the contact assembly 220 from the contact tube 222.

In an exemplary embodiment the connector 200 is a 600 A, 21.1 kV L-G loadbreak bushing for use with medium voltage switchgear or other electrical apparatus in a power distribution network of above 600V. It is appreciated, however, that the connector concepts described herein could be used in other types of connectors and in other types of distribution systems, such as high voltage systems, in which shock absorbent contact assembly stops are desirable.

The connector 200 is operable as follows. FIG. 3 illustrates the female connector 200 in a normal, or contracted operating position wherein the contact assembly 220 is positioned generally within the passage 209 of the contact tube 202. FIG. 4 illustrates the female connector 200 in the fault closure position, with the contact assembly 200 extended in an outwardly or expanded position relative to the contact tube 202.

During a loadbreak or switching operation, the male contact connector 102 (FIG. 1) is separated from the female contact connector 200. During the loadbreak, separation electrical contact occurs between the male contact element 114 and the female contact 224. During this separation as the male contact element 114 is pulled outward from the female connector 200 in the direction of arrow B, for example, there is a mechanical drag between the male contact element 114 and the female contact fingers 230. This drag might otherwise result in the movement of the female contact 224 within the contact tube 202, but due to the frictional forces at the interface between the piston 222 and the inner circumferential surface of the contact tube 202, the female contact 224 does not move within the contact tube 202.

In the joinder of the male connector 102 and the female connector 200 during loadmake, one connector is energized and the other is engaged with a normal load. Upon the attempted closure of male contact element 114 with the female contact 224, an arc is struck prior to actual engagement of the male contact element 114 with the female contact fingers 230 and continues until solid electrical contact is made therebetween. The arc passes from the male contact element 114 to the arc interrupter 228 and passes along the inner circumferential surface thereof, causing the generation of arc-quenching gases. These gases are directed inwardly within the female contact 224. The pressure of these gases applies a force to the arc snuffer housing 226 that in arc fault closure conditions is sufficient to overcome the frictional resistance of the contact piston 222, and the contact assembly 220, including the arc interrupter 228 and the arc snuffer housing 226 are moved from the normal position in FIG. 3 to the fault closure position of FIG. 4. However, an arc of moderate intensity, associated with loadbreak and loadmake operation will not produce adequate gas pressure to apply a sufficient force to overcome the frictional resistance and move the contact assembly 220 in the direction of arrow B.

During fault closure, the arc-quenching gas pressure moves the entire contact assembly 220 in the direction of arrow B toward the male contact element 114 to more quickly establish electrical contact between male contact probe 114 and female contact fingers 230. This accelerated electrical connection reduces the fractional time required to make connection and thus reduces the possibility of hazardous conditions during a fault closure situation.

As show in FIG. 4, in the fault closure position, the piston 222 engages the stop ring 240 and prevents further movement of the piston 222 in the direction of arrow B. The stop ring 240 absorbs impact forces as the piston 222 is decelerated and ensures that the female contact fingers 232 properly engage the male contact element 114, thereby avoiding fault closure failure and providing a more reliable connector 200 and connector system.

While the invention has been described in terms of various specific embodiments, those skilled in the art will recognize that the invention can be practiced with modification within the spirit and scope of the claims.

What is claimed is:

1. A separable loadbreak connector, comprising:

a contact tube having an axial passage therethrough;

a contact member slidably mounted within the axial passage and movable therein during a fault closure condition, the contact member axially movable within the passage with the assistance of an arc quenching gas during the fault closure condition; and a shock absorbent stop element mounted to the contact tube and limiting movement of the contact member in the fault closure condition, the shock absorbent stop element comprising a material that deforms when contacted by the contact member during the fault closure condition.

2. The connector of claim 1 wherein the stop element is fabricated from a nonconductive compressible material.

3. The connector of claim 1 further comprising a nonconductive nosepiece attached to the contact tube, the stop element integrally formed with the nosepiece.

4. The connector of claim 1 further comprising a tubular nosepiece fitted within and secured to an inner surface of the passage of the contact tube, the stop element extending on an end of the nosepiece within the passage.

5. The connector of claim 1 wherein the stop element comprises a tapered end.

6. The connector of claim 1 wherein the stop element comprises a stop ring.

7. The connector of claim 1 further comprising an arc snuffer housing coupled to the female contact member.

8. The connector of claim 1 wherein the contact tube is fitted within an elastomeric insulation.

9. The connector of claim 1 further comprising a ground shield surrounding the contact tube.

10. The connector of claim 1 further comprising a piston mounted within to passage, the contact member fixedly mounted to the piston and movable therewith, and the stop element positioned to engage the piston in the fault closure condition, thereby limiting movement of the contact member.

11. The connector of claim 1 wherein at least a portion of the material of the stop element deforms by at least one of shearing and tearing.

12. The connector of claim 1 wherein at least a portion of the material of the stop element deforms by at least one of breaking, cracking, shattering, collapsing, and compressing.

13. A separable loadbreak connector for making or breaking an energized connection in a power distribution network, comprising:

a conductive contact tube having an axial passage therethrough;

an elastomeric insulation surrounding the contact tube;

a conductive piston disposed within the passage and displaceable therein with the assistance of an arc quenching gas;

a female contact member mourned stationary to the piston; and a shock absorbent stop element within the axial passage and restricting displacement of the piston, the shock absorbent stop element comprising a material that deforms when contacted by the piston.

14. The connector of claim 13 wherein the stop element is fabricated from a nonconductive compressible material.

15. The connector of claim 13 further comprising a nonconductive nosepiece attached to the contact tube, the stop element integrally formed with the nosepiece.

16. The connector of claim 13 wherein the stop element comprises a tapered end facing the piston.

17. The connector of claim 13 wherein the stop element comprises a stop ring.

18. The connector of claim 13 further comprising an arc snuffer housing coupled to the female contact member.

19. The connector of claim 13 wherein at least a portion of the material of the stop element deforms by at least one of shearing and tearing.

20. The connector of claim 13 wherein at least a portion of the material of the stop element deforms by at least one of breaking, cracking, shattering, collapsing, and compressing.

21. A separable loadbreak connector to make or break a medium voltage connection with a male contact of a mating connector in a power distribution network, the separable loadbreak connector comprising:

a conductive contact tube having an axial passage therethrough;

an elastomeric insulation surrounding the contact tube;

a conductive piston disposed within the passage and displaceable therein with the assistance of an arc quenching gas;

a loadbreak female contact member mounted stationary to the piston;

an arc interrupter adjacent the female contact member and movable therewith; and a nonconductive nosepiece coupled to the contact tube and including an integrally formed, shock absorbent, stop ring at one end thereof, the stop ring placed in a path of the piston limiting movement of the piston relative to the contact tube in a fault closure condition, the stop ring comprising a material that deforms when contacted by the piston during the fault closure condition.

22. The connector of claim 21 wherein the nosepiece is fabricated from a compressible material.

23. The connector of claim 21 wherein the stop ring comprises a tapered end facing the piston.

24. The connector of claim 21 wherein one of the contact tube and the nosepiece includes a retaining flange, and the other of the contact tube and the nosepiece includes a retaining groove, the retaining flange fitted within the retaining groove at a location spaced from the stop ring.

25. The connector of claim 21 wherein at least a portion of the material of the stop element deforms by at least one of shearing and tearing.

26. The connector of claim 21 wherein at least a portion of the material of the stop element deforms by at least one of breaking, cracking, shattering, and collapsing.

27. A separable loadbreak connector comprising:

passage means for defining an axial contact passage;

loadbreak means, located within the axial contact passage, for making or breaking an energized electrical connection in a power distribution network;

positioning means, coupled to the loadbreak means, for axially displacing the loadbreak means within the contact passage;

assistance means, coupled to the positioning means, for displacing the positioning means during a fault closure condition;

arc interrupter means, adjacent the loadbreak means and movable therewith, for quenching an electrical arc during loadmake and loadbreak conditions; and stop means connected to the passage means for absorbing impact of the positioning means when the positioning means is displaced within the passage by a predetermined amount, the stop means comprising a material that deforms when contacted by the positioning means.

28. The connector of claim 27 wherein the material of the stop means comprises a compressible material.

29. The connector of claim 27 wherein the stop means comprises a ring located within the contact passage.

30. The connector of claim 27 wherein the stop means is integrally formed with nonconductive nosepiece means for accepting a male contact of a mating connector.

31. The connector of claim 27 further comprising means for insulating the passage means.

32. The connector of claim 27 wherein the loadbreak means comprises a female contact.

33. The connector of claim 27 wherein at least a portion of the material of the stop element deforms by at least one of shearing and tearing.

34. The connector of claim 27 wherein the material of the stop means deforms by at least one of breaking, cracking, shattering, and collapsing.

35. A separable loadbreak connector system to make or break a medium voltage energized connection in a power distribution network, the system comprising:

a male connector having a male contact; and a female loadbreak connector comprising:

a conductive contact tube having an axial passage therethrough;

an elastomeric insulation surrounding the contact tube;

a conductive piston disposed within the passage;

a loadbreak female contact member mounted stationary to the piston and configured to receive the male contact when the male and female connectors are mated, the female contact member and the piston axially displaceable within the contact passage toward the male contact due to accumulated pressure of an arc quenching gas when the male and female connectors are mated to one another in a fault closure condition;

an arc interrupter adjacent the female contact member and movable therewith; and a shock absorbent stop element configured to absorb impact of the piston during the fault closure condition and substantially prevent displacement of the piston beyond a predetermined distance within the contact tube, the shock absorbent stop element comprising a material that deforms when contacted by the piston during the fault closure condition.

36. The system of claim 35 further comprising a nonconductive nosepiece coupled to the contact tube, wherein the stop element is integrally formed with the nosepiece.

37. The system of claim 35 wherein the stop element comprises a stop ring positioned within the passage.

38. The system of claim 35 wherein the stop element is fabricated from a nonconductive compressible material.

39. The system of claim 35 wherein at least a portion of the material of the stop element deforms by at least one of shearing and tearing.

40. The system of claim 35 wherein at least a portion of the material of the stop element deforms by at least one of breaking, cracking, shattering, collapsing, and compressing.

* * * * *

UNITED STATES PATENT AND TRADEMARK OFFICE

CERTIFICATE OF CORRECTION

PATENT NO. : 7,341,468 B2
APPLICATION NO. : 11/192965
DATED : March 11, 2008
INVENTOR(S) : Hughes et al.

It is certified that error appears in the above-identified patent and that said Letters Patent is hereby corrected as shown below:

Column 2, lines 61-62, "within the contact passage within the contact passage" should read --within the contact passage--

Column 7, line 10, "noise" should read --nose--

Claim 10, Column 9, line 60, "to" should read --the--

Claim 13, Column 10, line 13, "mourned" should read --mounted--

Claim 34, Column 11, line 40, "wherein the material" should read --wherein at least a portion of the material--

Signed and Sealed this

Twenty-ninth Day of July, 2008

JON W. DUDAS
*Director of the United States Patent and Trademark Office*